United States Patent [19]

Klapp

[11] 4,240,539

[45] Dec. 23, 1980

[54] BACKUP STATION FOR A CARTON FILLING MACHINE

[75] Inventor: Hartmut Klapp, Kaarst, Fed. Rep. of Germany

[73] Assignee: Jagen-Werke AG, Dusseldorf, Fed. Rep. of Germany

[21] Appl. No.: 22,134

[22] Filed: Mar. 20, 1979

[30] Foreign Application Priority Data

Jun. 9, 1978 [DE] Fed. Rep. of Germany ..... 2825420

[51] Int. Cl.[3] ..... B05B 1/30; B05B 1/02

[52] U.S. Cl. ..... 198/461; 198/573; 198/577; 271/3.1; 271/151; 271/216

[58] Field of Search ..... 271/3.1, 151, 216, 273, 271/274; 198/459, 460, 461, 462, 572, 573, 577

[56] References Cited

U.S. PATENT DOCUMENTS 4,149,626 4/1979 Holt ..... 198/460

FOREIGN PATENT DOCUMENTS 34662 6/1962 German Democratic Rep. ..... 271/216
2214533 10/1972 Fed. Rep. of Germany .
2251108 5/1974 Fed. Rep. of Germany ..... 198/462

*Primary Examiner*—Robert W. Saifer
*Attorney, Agent, or Firm*—Sughrue, Rothwell, Mion, Zinn and Macpeak

[57] ABSTRACT

A backup station in a carton filling machine for the delivery and packaging of premanufactured blanks into transport containers. The station is arranged between an imbrication station and a delivery belt which includes a rotation station. Within the backup station, a support rail is arranged in the direction of delivery of the blanks which provides support for the blanks. Two conveyor belts running along the support rail are raised above the surface of the support rail during normal operation and are lowered by the backed-up blanks during backed-up operation.

7 Claims, 4 Drawing Figures

BACKUP STATION FOR A CARTON FILLING MACHINE

BACKGROUND OF THE INVENTION

In carton filling machines of the type to which the invention pertains, premanufactured blanks are brought to a rotation station by means of a delivery belt. In the rotation station, the blanks are turned 90° relative to their previous direction of delivery so that they are delivered to the backup station laterally. In the backup station, the blanks are transported further in the original direction of delivery until they reach the imbrication station.

A backup station is provided so as to make possible the continuous operation of the delivery belt even if at the end of the machine the carton serving as the transport container must be shifted or exchanged for a new carton after it has been filled. For this purpose, when the imbrication station is not operating, the blanks in the backup station can be stacked or imbricated in a more nearly upright position and can be backed up thereby. Accordingly, the conveyor belt in the backup station must have a speed such that the blanks arriving from the rotation station can be continuously removed.

Continuous running of the conveyor belt in the backup station results in constant friction on the lower edges of the upright, backed-up blanks as a result of the pressure of the belt which continuously attempts to transport the blanks. This may lead to damage to the lower edges and to bending and improper shifting of the entire backed-up packet of blanks.

SUMMARY OF THE INVENTION

A basic object of the invention is the provision of a backup station of the above-described type in which the transport means is free of normal conveying contact with the erected, upright and backed-up blanks in the backup area.

This object is achieved in accordance with the invention wherein the backup station has at least one support rail arranged in the direction of delivery of the blanks to support the blanks. The backup station also has at least two conveyor belts running along the support rail which are raised above the surface of the support rail during non back-up operation and are lowered to the surface plane of the support rail by backed-up blanks during backup operation.

With this structure of support rail and conveyor belts, the support rail has no effect during normal delivery operation as the delivered blanks lie on the two transport belts and do not contact the support rail. However, as soon as the blanks are placed upright to form a packet in the course of the backup operation, the packet of blanks, which is limited in its upward movement, presses the conveyor belts downwards until the blanks lie on the support rail so that the conveyor belts therefore at that point no longer perform the sole support function for the packet of blanks. This avoids damage to the lower edges of the blanks as well as any possible shifting of the blanks or of the entire packet.

For wider blanks, it is desirable to provide three conveyor belts with two support rails arranged therebetween.

Advantageously, the conveyor belts run on guide rollers which press the conveyor belts beyond the surface of the support rail by means of roller levers which are tensioned by springs arranged between the roller levers and a ledge. The lowering of the conveyor belts due to the backed-up blanks is accomplished against the force of the springs. To adjust the spring force, the ledge height may be made adjustable. In this embodiment of the invention, the highest position of the guide rollers is appropriately limited by a stop for each roller lever. The diversion of the conveyor belts at the imbrication station takes place effectively by means of an oscillating roller.

In order to provide for proper transport and backup of the blanks, it is desirable to provide a bead chain above the support rail and conveyor belts, which bead chain is attached at the entrance and exit of the backup station and is raised by the transported blanks. Above the bead chain a limiting rail may be provided which limits the upward movement of the bead chain in order to establish the maximum upright angle of the backed up blanks.

An exemplary embodiment of the invention is shown in the drawings and is described below in greater detail.

DESCRIPTION OF THE PREFERRED EMBODIMENT

Figure 1:
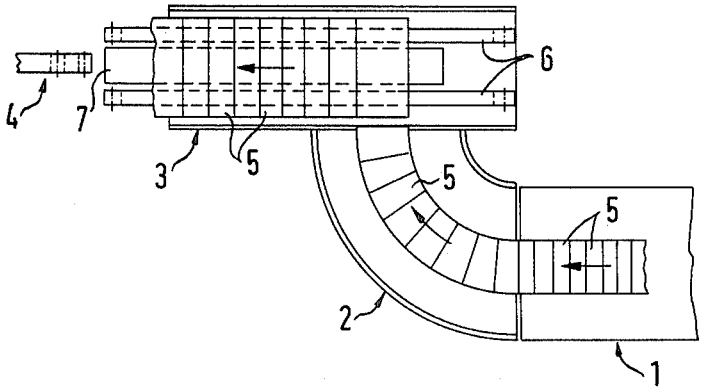
FIG. 1 is a schematic top view of a backup station showing a rotation station and partially showing a delivery belt and imbrication station.

The portion of a carton filling machine shown in FIG. 1 includes a delivery belt 1, a rotation station 2, a backup station 3 and an imbrication station 4, which are arranged sequentially in that order in the direction of delivery. Premanufactured blanks 5 are transferred from delivery belt 1 to rotation station 2, are there rotated by 90° relative to the direction of delivery and are guided laterally into backup station 3. From backup station 3, blanks 5 are transported further parallel to the direction of delivery of the delivery belt 1 to imbrication station 4.

Figure 2:
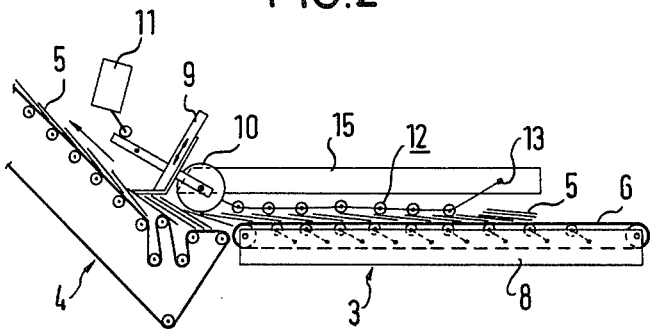
FIG. 2 is a schematic illustration of the backup station of FIG. 1 in side view showing blanks passing therethrough.
Figure 3:
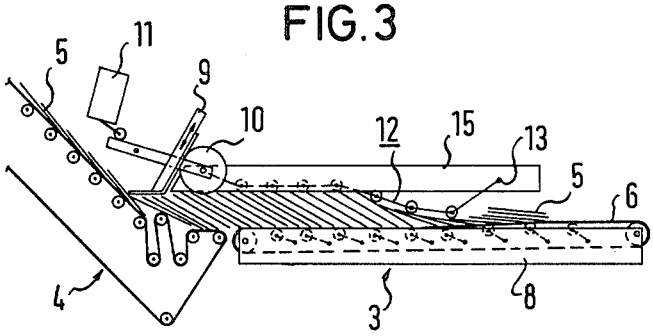
FIG. 3 is a schematic illustration of the backup station as in FIG. 2 but with partially backed-up blanks.

In FIGS. 2 and 3, backup station 3 is illustrated with subsequent imbrication station 4 in side view for two different operation conditions. In the condition shown in FIG. 2, blanks 5 coming from rotation station 2 run continuously through backup station 3 and are transferred to imbrication station 4. Transport in backup station 3 is performed by two parallel conveyor belts 6 between which is positioned a longitudinally running support rail 7. The surface of support rail 7 (which is shown in top view in FIG. 1 but which is not shown in any other figures) is flush with the upper edge of the frame 8 of conveyor belts 6 and support rail 7 as shown in FIGS. 2 and 3.

In the transitional area between backup station 3 and the imbrication station 4 and immediately adjacent imbrication station 4, there is provided a positioning tongue 9 which directs the upper edges of blanks 5 from backup station 3 before they are conveyed further in imbricated fashion within imbrication station 4. Positioning tongue 9 is tensioned by a spring and is moved by the blanks in the directions shown by the double arrow.

Behind positioning tongue 9 towards backup station 3 there is provided a feeler roller 10, which operates in conjunction with roller damper 11 by means of a lever arm. Roller damper 11 determines the delivery speed in the imbrication station in dependence upon whether a backup of blanks has occurred in the area of feeler roller 10.

Such a backup of blanks, which may be caused by an event such as the exchange of filling cartons and a corresponding idleness in delivery at imbrication station 4, can be seen in FIG. 3. Here, feeler 10 is fully raised and accordingly roller damper 11 is set for maximum delivery speed at imbrication station 4 as soon as imbrication station 4 again begins to transport blanks 5 after completion of the exchange of the filling cartons for the blanks.

Figure 4:
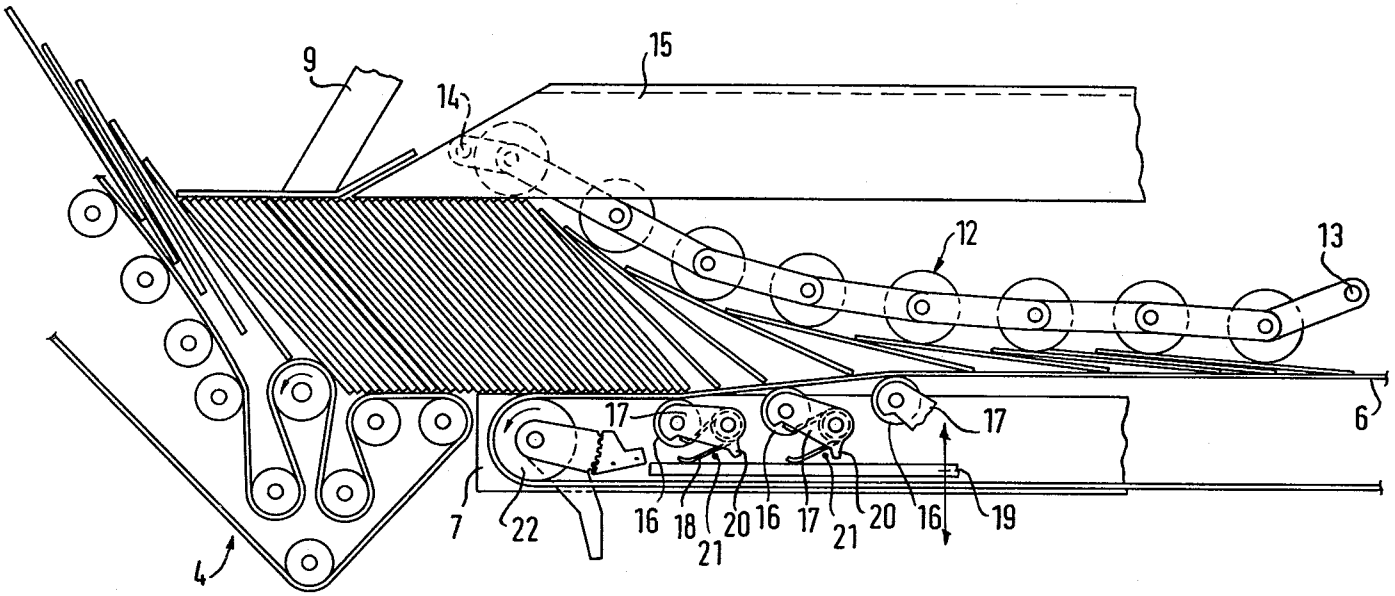
FIG. 4 is an enlarged schematic illustration of the backup station with upright, backed up blanks.

A bead chain 12, which has been raised by the delivered blanks, is provided above support rail 7 and conveyor belts 6. Bead chain 12, which is seen most clearly in FIG. 4, is attached at a point 13 at the entrance and at a point 14 at the exit of backup station 3. A limiting rail 15 is provided above bead chain 12 to limit the upward movement of the blanks. Limiting rail 15 assures that the angle of inclination of blanks 5 in the backup area does not exceed an allowable value for continued processing.

In FIG. 4, there is illustrated an enlarged side view of backup station 3 but with feeler roller 10 eliminated. As may be clearly seen in FIG. 4, conveyor belt 6 runs over guide rollers 16 one of which is arranged on each roller lever 17. The roller levers 17 are urged upwards by springs 18. A ledge 19 forms a common stop for all springs 18 and can be either rigidly arranged or, alternatively, can be height-adjustable in order to adjust the force of springs 18. A projection 20 is provided on each roller lever 17 which abut respective stops 21. Stops 21 limit the upward movement of guide rollers 16 to thereby determine the continuous transport position of conveyor belt 6. Diversion of conveyor belt 6 at imbrication station 4 is effected by means of an oscillating roller 22.

As may be clearly seen in FIG. 4, the surface of conveyor belt 6 is flush in the backup area with the surface of support rail, 7 while in the area having no backed up blanks where the blanks must still be moved, the surface of conveyor belt 6 moves above that of support rail 7 and the transport of blanks 5 thus takes place with the full conveying effect of conveyor belt 6 without contacting support rail 7.

What is claimed is:

1. A backup station in a carton filling machine for guiding and loading premanufactured blanks into transport containers, arranged between an imbrication station and a delivery belt which includes a rotation station, the backup station comprising:

at least one support rail arranged in the direction of delivery of blanks for supporting said blanks; and at least two conveyor belts running along said support rail, said conveyor belts being raised above the surface of said support rail during normal, non-backed up operation and being lowered by the backed-up blanks to the surface of said support rail in backed-up operation.

2. A backup station according to claim 1, characterized in that three conveyor belts are provided together with two support rails respectively arranged therebetween.

3. A backup station according to claim 1, further comprising:

a plurality of roller levers;

a ledge;

spring means coupled to each of said roller levers and to said ledge;

a plurality of guide rollers coupled to said roller levers, said guide rollers pressing on said conveyor belts above the surface of said support rail urged by said spring means.

4. A backup station according to claim 3, wherein said ledge is height-adjustable.

5. Backup station according to claim 3 further comprising stop means for each of said roller levers for limiting the highest position of said guide rollers.

6. A backup station according to claim 1, further comprising:

a bead chain positioned above said support rail and said conveyor belts, said bead chain being attached at the entrance and exit of said backup station and being raised by delivered blanks.

7. A backup station according to claim 6, further comprising a limit rail positioned above said bead chain for limiting the upward movement of the blanks.

* * * * *

UNITED STATES PATENT AND TRADEMARK OFFICE

CERTIFICATE OF CORRECTION

PATENT NO. : 4,240,539

DATED : December 23, 1980

INVENTOR(S) : Hartmut Klapp

It is certified that error appears in the above-identified patent and that said Letters Patent are hereby corrected as shown below:

On the title page, Item /73/ should read:

--- Jagenberg-Werke AG, Dusseldorf, Fed. Rep. of Germany---.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*